US006293476B1

(12) United States Patent
Pettit

(10) Patent No.: US 6,293,476 B1
(45) Date of Patent: Sep. 25, 2001

(54) SPRAY GUN NOZZLE ASSEMBLY AIR CAP

(75) Inventor: Neville T. Pettit, Lymington (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/607,193

(22) Filed: Jun. 28, 2000

(51) Int. Cl.[7] ..... B05B 1/28
(52) U.S. Cl. ..... 239/290; 239/291; 239/297
(58) Field of Search ..... 239/290, 291, 239/292, 296, 297, 418

(56) References Cited

U.S. PATENT DOCUMENTS 2,569,251 * 9/1951 Nieburg ..... 239/297
3,635,401 * 1/1972 Bromley et al. ..... 239/15
4,380,320 * 4/1983 Hollstein et al. ..... 239/290
5,090,623 2/1992 Burns et al. .
5,169,070 * 12/1992 Mattson ..... 239/290
5,170,941 * 12/1992 Morita et al. ..... 239/290
5,330,108 * 7/1994 Grime et al. ..... 239/578
5,344,078 9/1994 Fritz et al. .

* cited by examiner

*Primary Examiner*—David A. Scherbel
*Assistant Examiner*—Davis Hwn
(74) *Attorney, Agent, or Firm*—Paul F. Donovan

(57) ABSTRACT

An HVLP spray gun air cap having an axial passage with a cap opening on an outer side thereof, first and second air horns protruding from the outer side of the air cap on opposite sides of the cap opening, first and second diverging air passages disposed in the air cap having corresponding orifices on the outer side thereof, the first and second diverging air passages disposed on opposite sides of the cap opening and aligned perpendicular to air passages of the first and second air horns.

20 Claims, 2 Drawing Sheets

SPRAY GUN NOZZLE ASSEMBLY AIR CAP

BACKGROUND OF THE INVENTION

The invention relates generally to spray gun nozzles, and more particularly to air caps for high volume low pressure air atomization paint spray gun nozzle assemblies.

Spray gun nozzle assemblies, including those used in high volume low pressure atomization paint spray guns, are known generally. U.S. Pat. No. 5,344,078 entitled "Nozzle Assembly for HVLP Spray Gunl", assigned commonly with the present application, for example discloses a spray gun nozzle assembly comprising a fluid tip protruding into a cap opening of an air cap from an inner side thereof to form a generally conical annulus therebetween. See generally U.S. Pat. No. 5,090,623 entitled"Paint Spray Gun", also assigned commonly herewith.

The known spray gun nozzle assembly air caps also comprise two air horns protruding from an outer side thereof on opposite sides of the cap opening. The air horns each include one or more horn air orifices that emit corresponding air jets that converge upon and shape an expanding conical atomized fluid flow dispensed from the cap opening into a generally flat fan shape. U.S. Pats. Nos. 5,344,078 and 5,090,623.

It is also known to provide pairs of relatively small air passages having orifices on the outer side of the air cap between the cap opening and each of the air horns. The small air passages direct air jets on either side of the airjets emitted from the orifices of the air horns to reduce paint accumulation on the air cap and to help transport spray toward the target. U.S. Pat. No. 5,344,078.

An object of the present invention is to provide novel air caps that improve upon and overcome problems in the art.

Another object of the invention is to provide novel air caps that are economical and reliable.

A further object of the invention is to provide novel spray gun nozzle air caps that produce improved spray patterns.

It is another object of the invention to provide novel spray gun nozzle air caps that produce spray patterns having increased width.

Yet another object of the invention is to provide novel spray nozzle air caps that produce spray patterns having reduced spray density toward outer end portions thereof.

A more particular object of the invention is to provide novel spray gun air caps comprising an axial passage with a cap opening on an outer side thereof, first and second air horns protruding from the outer side of the air cap on opposite sides of the cap opening, first and second diverging air passages disposed in the air cap having corresponding orifices on the outer side thereof, the first and second diverging air passages disposed on opposite sides of the cap opening and aligned generally perpendicular to the first and second air horns.

Another more particular object of the invention is to provide novel air caps for HVLP spray gun nozzle assemblies, comprising a body member having an axial passage with a cap opening on an outer side thereof, first and second air horns protruding from the outer side of the body member on opposite sides of the cap opening, the first and second air horns having corresponding horn air passages therein, first and second diverging air passages extending through the body member having corresponding orifices on the outer side thereof, the first and second diverging air passages diverging from the passage axis in a direction away from the outer side of the body member, the first and second diverging air passages disposed on opposite sides of the cap opening and aligned perpendicular to the horn air passages.

Yet another more particular object of the invention is to provide novel improvements in HVL,P spray gLul air caps having an axial passage with a cap opening on an outer side thereof and first and second air horns protruding therefrom on diametrically opposite sides of the cap opening, comprising first and second air passages disposed in the air cap having corresponding first and second orifices on the outer side thereof, the first and second air passages disposed on opposite sides of the cap opening generally perpendicular to the alignment of the first and second air horns, and the first and second air passages diverging from the passage axis in a direction away from the outer side of the air cap.

These and other objects, aspects, features and advantages of the present invention will become more fully apparent upon careful consideration of the following Detailed Description of the Invention and the accompanying, Drawings, which may be disproportionate for ease of understanding, wherein like structure and steps are referenced generally by corresponding numerals and indicators.

DETAILED DESCRIPTION OF THE INVENTION

The exemplary air cap is for an exemplary HVLP spray gun nozzle assembly application of the well known type disclosed generally in the referenced U.S. Pat. No. 5,344,078 entitled"Nozzle Assembly for HVLP Spray Gun". The air caps of the present invention may however be used in applications other than HVLP spray guns.

Figure 1:
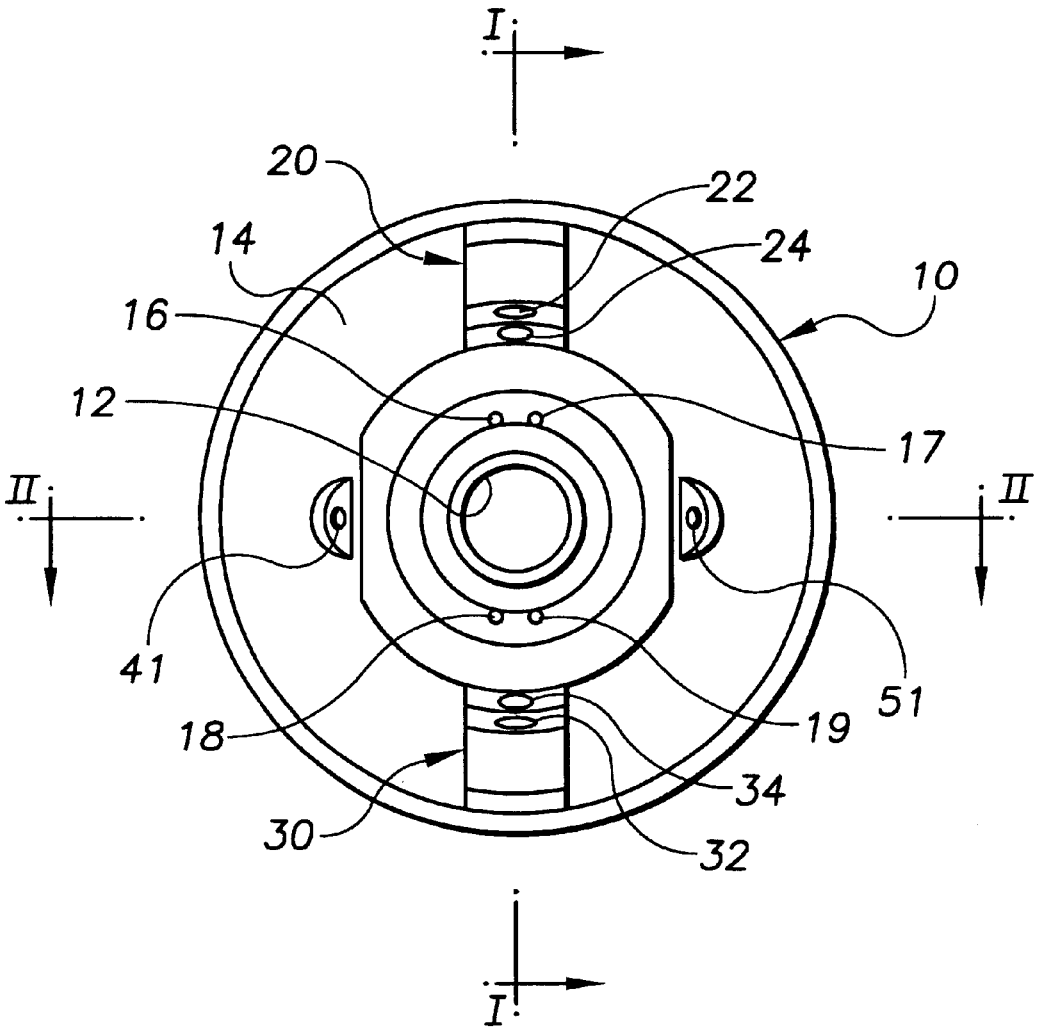
FIG. 1 is a plan view of a spray gun nozzle air cap according to an exemplary embodiment of the invention.
Figure 2:
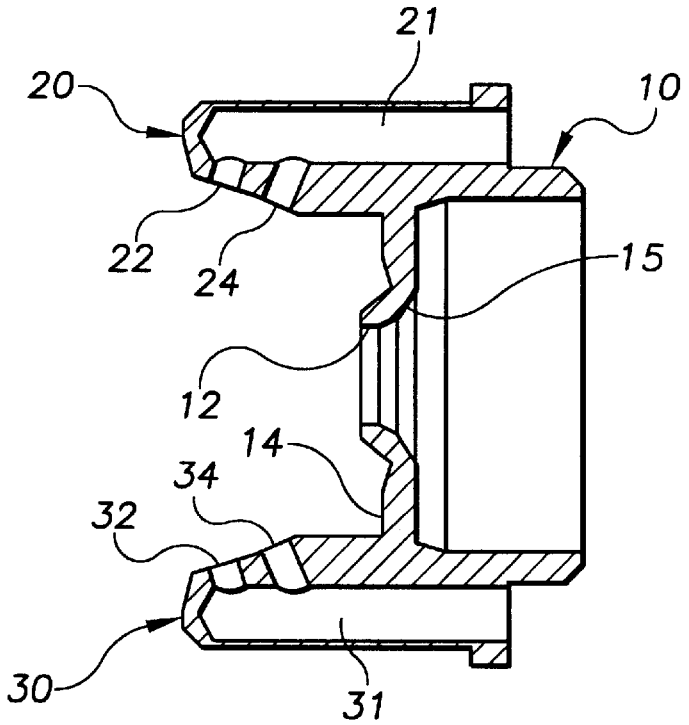
FIG. 2 is a sectional view along lines I—I of FIG. 1.

In FIGS. 1 and 2, the air cap comprises a body member 10 having an axial passage with a cap opening 12 on an outer side 14 thereof. In FIG. 2, the axial passage extends through the air cap and preferably has one or more a substantially conical surface portions 16 disposed about the cap opening 12 on an inner side of the body member.

In FIGS. 1 and 2. the air cap comprises first and second air horns 20 and 30 protruding from the outer side 14 thereof on opposite sides of the cap opening 12. The first and second air horns each generally include one or more horn air passages with corresponding horn orifices facing generally toward the passage axis. In FIGS. 1 and 2, the exemplary first air horn includes first and second horn air passages disposed therein with corresponding horn orifices 22 and 24, and the exemplary second air horn includes first and second horn air passages disposed therein with corresponding horn orifices 32 and 34.

The horn air passages of the first and second air horns are preferably arranged symmetrically about the cap opening and arc directed toward the passage axis, generally away from the outer side of the body member. The horn air passages of the first and second air horns communicate with corresponding air flow passages 21 and 3 1, which supply air thereto.

Thus configured, air jets directed from the orifices of the horn air passages converge upon the diverging atomized spray emitted from the cap opening 12 to form a generally flattened spray pattern, as is known generally and disclosed more fully in the referenced U.S. Pat. No. 5,344,078 entitled "Nozzle Assembly for HVLP Spray Gun".

In FIG. 1, a first pair of air passages are disposed in the air cap having corresponding orifices 16 and 17 on the outer side thereof near the first air horn 20 on opposite sides of the horn orifices 22 and 24 thereof, and a second pair of air passages are disposed in the air cap having corresponding orifices 18 and 19 on the outer side thereof near the second air horn 30 on opposite sides of the horn orifices 32 and 34 thereof. The orifices 16 and 17 are disposed generally between the cap opening 12 and the first air horn 20, and the orifices 18 and 19 are disposed generally between the cap opening 12 and the second air horn 30.

Figure 3:
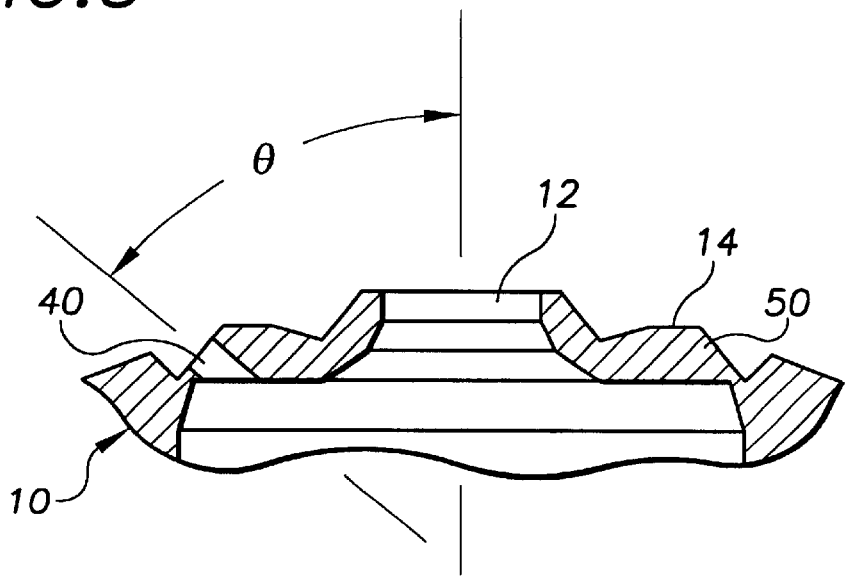
FIG. 3 is a sectional view along line II—II of FIG. 1.

In FIG. 3 the air cap further comprises first and second diverging air passages 40 and 50 disposed in the body member 10 on opposite sides of the cap opening 12, preferably symmetrically thereabout, with corresponding orifices on the outer side thereof.

In FIG. 1, the diverging air passages having corresponding orifices 41 and 51 on the outer side 14 of the body member aligned generally perpendicular to the alignment of the first and second air horns, and particularly the alignment of the horn air passages thereof.

In FIG. 3, the first and second diverging air passages 40 and 50 each diverge at an angle θ measured from the passage axis through the cap opening between approximately 20 degrees and approximately 70 degrees. In one embodiment suitable for the exemplary HVLP spray gun nozzle assembly application, the angle θ is approximately 45 degrees.

Air jets emitted from the first and second diverging air passages 40 and 50 increase the width of the spray pattern and reduce the spray density at opposite end portions thereof The spray pattern for a given application may be optimized by appropriately selecting the angle of the passages 40 and 50 relative to the passage axis, the spacing of the corresponding orifices from the cap opening, the diameters of the orifices, and the corresponding air flow rates, all of which may be determined without undue experimentation by those of ordinary skill in the art based on the disclosure herein.

In one exemplary embodiment suitable for the exemplary HVLP spray gun nozzle assembly application, the orifice diameter of the passages 40 and 50 is approximately 1.15 mm, the diameters of the horn orifices 22 and 32 is approximately 2.20 mm, the diameters of the horn orifices 24 and 34 is approximately 1.80 mm.

The exemplary air cap is a unitary metal member, formed for example of brass.

While the foregoing written description of the invention enables one of ordinary skill to make and use what is considered presently to be the best mode thereof those of ordinary skill will understand and appreciate the existence of variations, combinations, and equivalents of the specific exemplary embodiments herein. I he invention is therefore to be limited not by the exemplary embodiments herein, but by all embodiments within the scope and spirit of the appended claims.

What is claimed is:

1. A spray gun air cap, comprising:

an axial passage having a cap opening on an outer side of the air cap;

first and second air horns protruding from the outer side of the air cap on opposite sides of the cap opening;

first and second diverging air passages disposed in the air cap having corresponding orifices on the outer side thereof, remaining portions of the outer side of the body member between the orifices of the first and second diverging air passages and the first and second air horns devoid of other air openings, the first and second diverging air passages disposed on opposite sides of the cap opening and aligned generally perpendicular to the first and second air horns.

2. The air cap of claim 1, a first horn air passage in the first air horn, a second horn air passage in the second air horn, the horn air passages of the first and second air horns directed toward the passage axis, the first and second diverging air passages aligned perpendicular to the horn air passages of the first and second air horns.

3. The air cap of claim 2, a first pair of air passages disposed in the air cap having corresponding orifices on the outer side thereof near the first air horn on opposite sides of a first horn orifice thereof, a second pair of air passages disposed in the air cap having corresponding orifices on the outer side thereof near the second air horn on opposite sides of a second horn orifice thereof.

4. The air cap of claim 3, the orifices of the first pair of air passages disposed generally between the cap opening and the first air horn, the orifices of the second pair of air passages disposed generally between the cap opening and the second air horn.

5. The air cap of claim 1, the first and second air horns each having first and second horn air passages therein, the first and second horn air passages of the first and second air horns are aligned and converge toward the passage axis, the first and second diverging air passages aligned perpendicular to the alignment of the first and second horn air passages of the first and second air horns.

6. The air cap of claim 1, the axial passage of the air cap having a substantially conical surface disposed about the cap opening on an inner side of the air cap.

7. The air cap of claim 1 is a unitary metal member.

8. The air cap of claim 1, the first and second diverging air passages disposed symmetrically about the passage axis.

9. The air cap of claim 1, the first and second diverging air passages each diverge between approximately 20 and approximately 70 degrees from the passage axis.

10. An air cap for an HVLP spray gun nozzle assembly, comprising:

a body member having an axial passage disposed therein, the axial passage having a cap opening on an outer side of the body member;

a first air horn protruding from the outer side of the body member on one side of the cap opening, and a second air horn protruding from the outer side of the body member on an opposite side of the cap opening, the first and second air horns having corresponding horn air passages;

first and second air passages extending through the body member having corresponding orifices on the outer side thereof, the outer side of the body member otherwise devoid of air openings, the first and second air passages diverging from the passage axis in a direction away from the outer side of the body member, the first and second air passages disposed on opposite sides of the cap opening and aligned perpendicular to the horn air passages.

11. The air cap of claim 10, the horn air passages of the first and second air horns directed toward the passage axis and away from the outer side of the body member.

12. The air cap of claim 10, the first air horn having first and second horn air passages, the second air horn having first and second horn air passages, the horn air passages of the first and second air horns extending away from the outer side of the body member and convergent upon the passage axis.

13. The air cap of claim 12, a first pair of air passages disposed in the body member having corresponding orifices on the outer side thereof near the first air horn on opposite sides of the horn orifices thereof, a second pair of air passages disposed in the body member having corresponding orifices on the outer side thereof near the second air horn on opposite sides of the horn orifices thereof.

14. The air cap of claim 13, the orifices of the first pair of air passages disposed between the cap opening and the first air horn, the orifices of the second pair of air passages disposed between the cap opening and the second air horn.

15. The air cap of claim 14 is a unitary metal member comprising brass.

16. The air cap of claim 10, the axial passage having a substantially conical surface disposed about the cap opening on an inner side of the air cap.

17. The air cap of claim 10, the first and second diverging air passages disposed symmetrically about the passage axis.

18. The air cap of claim 17, the first and second diverging air passages disposed on opposite sides of the cap opening each diverge approximately 45 degrees from the passage axis.

19. In an HVLP spray gun air cap having an axial passage with a cap opening on an outer side thereof otherwise devoid of air openings, and first and second air horns protruding therefrom on diametrically opposing sides of the cap opening, the improved air cap comprising:

a first air passage disposed in the air cap having a first orifice on the outer side thereof, the first air passage diverging from the passage axis in a direction away from the outer side of the air cap;

a second air passage disposed in the air cap having a second orifice on the outer side thereof, the second air passage diverging from the passage axis in a direction away from the outer side of the air cap;

the first and second air passages disposed on opposite sides of the cap opening and aligned generally perpendicular to the alignment of the first and second air horns.

20. The improvement of claim 19, the first and second diverging air passages disposed symmetrically about the passage axis and aligned perpendicular to horn air passages in the first and second air horns.

* * * * *